United States Patent [19]

Shimomoto

[11] Patent Number: 4,638,488

[45] Date of Patent: Jan. 20, 1987

[54] FINE GRAINS PRODUCING APPARATUS

[75] Inventor: Yasunobu Shimomoto, Nagoya, Japan

[73] Assignee: Daidotokushuko Kabushikikaisha, Nagoya, Japan

[21] Appl. No.: 767,245

[22] Filed: Aug. 20, 1985

[30] Foreign Application Priority Data

Jun. 20, 1985 [JP] Japan ..... 60-135075

[51] Int. Cl.[4] ..... H05H 1/00

[52] U.S. Cl. ..... 373/22; 373/18; 219/121 PR; 75/0.5 C; 75/0.5 B; 264/10

[58] Field of Search ..... 373/18–25, 373/60, 79, 90, 107, 85; 264/10; 75/0.5 B, 0.5 BB, 0.5 C; 219/121 PP, 121 PM, 121 PA, 121 PB, 123

[56] References Cited

U.S. PATENT DOCUMENTS 3,975,184 8/1976 Akers ..... 264/10 X
4,275,287 6/1981 Hiratake ..... 219/121 PR

*Primary Examiner*—Roy N. Envall, Jr.
*Attorney, Agent, or Firm*—Berman, Aisenberg & Platt

[57] ABSTRACT

A toroidal pile of raw material is contained in a toroidal melting pot provided in the lower portion of a furnace and a ring plasma torch is mounted over the toroidal pile of the raw material. A ring plasma arc, driven electromagnetically and rotating azimuthally between the torch and the pile, heats a certain portion of the pile intermittently and periodically. Fine grains are produced in such portion of the pile of raw material that is not heated directly by the plasma arc and collected through a discharge port provided around the major axis of the toroidal melting pot.

4 Claims, 3 Drawing Figures

FINE GRAINS PRODUCING APPARATUS

BACKGROUND OF THE INVENTION

1. Field of the Invention

This invention relates generally to a plasma remelting furnace and more particularly to a fine-grain producing apparatus wherein raw material, such as metal, is turned into a molten pool as a result of heating by a plasma arc and fine grains are produced efficiently from the molten pool and are collected without loss.

2. Description of the Prior Art

In known find-grain-producing apparatus of this type, metallic raw material supplied to the bottom portion of a furnace is heated by a plasma arc until molten and is thereafter formed into fine grains. In this process, the heating region for the raw material is generally restricted and spatially fixed. Consequently, heat conduction in molten metal or inflow of unmolten row material into the heating region accompanying outflow of molten raw material from there must take place in order to melt all the supplied raw material completely. As the result of this, the level of the yield of fine grains is generally low, it takes a considerable length of time to produce a certain amount of fine grains and, to make matters worse, the homogeneity of the obtained fine grains is uncertain. An apparatus is also known wherein the direction of a plasma arc produced by a plasma torch is variably adjusted to a certain degree. In such an apparatus, however, the direction of the plasma arc is adjusted, on rare occasions, by an operator, and a plasma arc is spatially fixed basically in the process of producing fine grains.

In conventional apparatus of this type, metallic fine grains are formed in a restricted region near a molten pool and are removed through a few discrete discharge ports provided at the side wall of the furnace. Since the motion of produced fine grains carried by a flow of neutral gas for plasma medium is complicated and the fine grains are moreover directed towards the side wall of the furnace, the fine grains stray through the furnace until they arrive at the discharge ports. Some of the fine grains are subsequently attached to the side wall of the furnace, causing trouble, such as deterioration of electrical insulation, or are piled up in corners of a furnace, resulting in the further decrease in yield.

SUMMARY OF THE INVENTION

The present invention provides several means, as described in appended claims, and the fundamental operation thereof is as follows. A plasma arc produced by a plasma ring torch, which is mounted coaxially with a furance at the upper portion of it, is obliquely directed toward and down against a toroidal pile of raw material placed in the bottom portion of the furnace. This plasma arc is electromagnetically driven in the azimuthal direction around the major axis of the apparatus and homogeneously heats an arbitrary portion of the toroidal pile of raw material for a fixed period. A wide toroidal heating region can be obtained, and fine grains are simultaneously produced in a nonheating region where the plasma arc is not directed. On the other hand, the working gas of the plasma torch flows radially towards a discharge port positioned around the major axis of the toroidal pile of raw material, and the produced fine grains are effectively collected.

One object of the present invention is, accordingly, to provide a fine-grain-producing apparatus wherein the heating region is spatially displaced, resulting in an effectively wide heating region, and a high yield of high quality fine grains is guaranteed.

Another object of the present invention is to provide a fine-grain-producing apparatus wherein a ring plasma torch generates a plasma arc driven electromagnetically and rotated azimuthally between the torch and a toroidal pile of raw material for fine grains.

Still another object of the present invention is to provide a fine-grain-producing apparatus wherein produced fine grains are more effectively collected by the flow of transfer gas supplied along the major axis of the apparatus.

DETAILED DESCRIPTION OF THE PREFERRED EMBODIMENT

Figure 1:
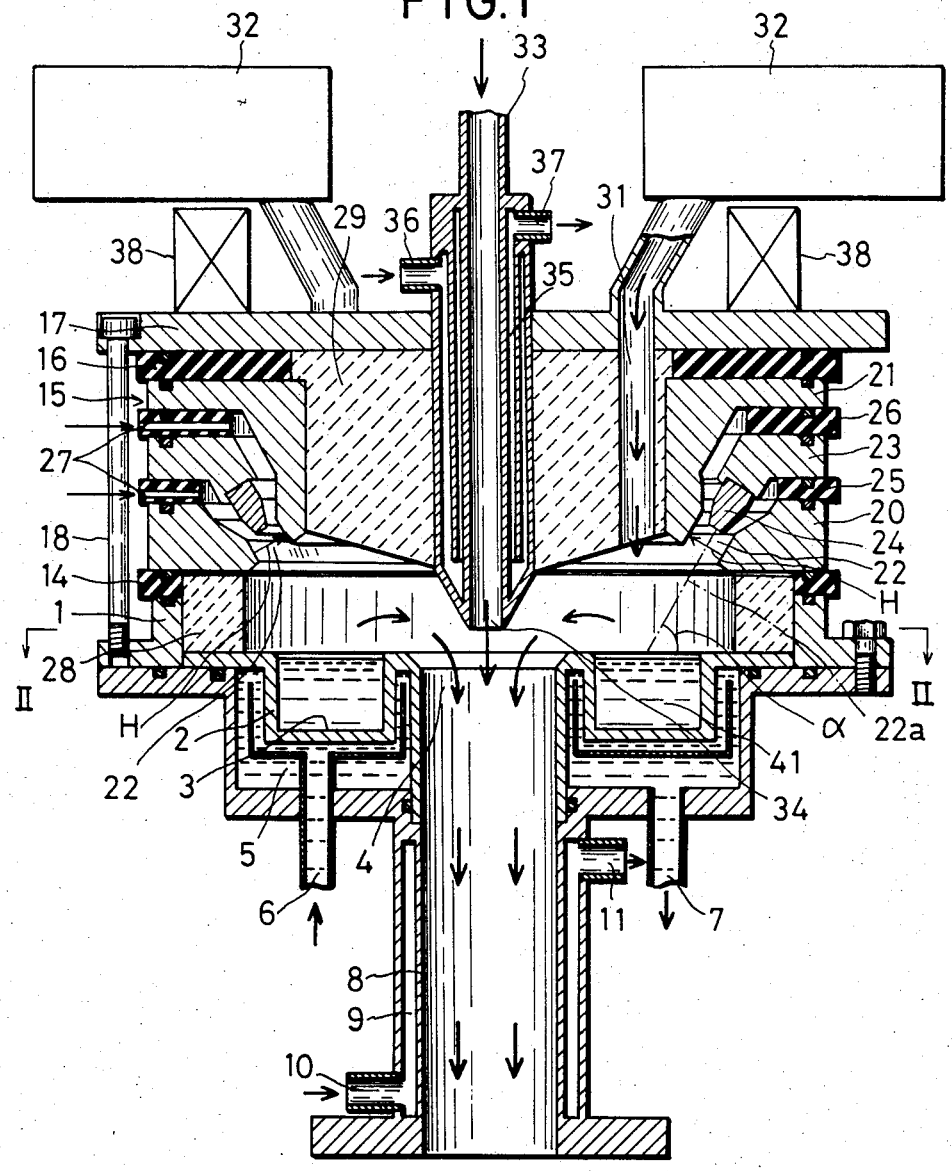
FIG. 1 is a longitudinal section of a fine-grains-producing apparatus according to the present invention.
Figure 2:
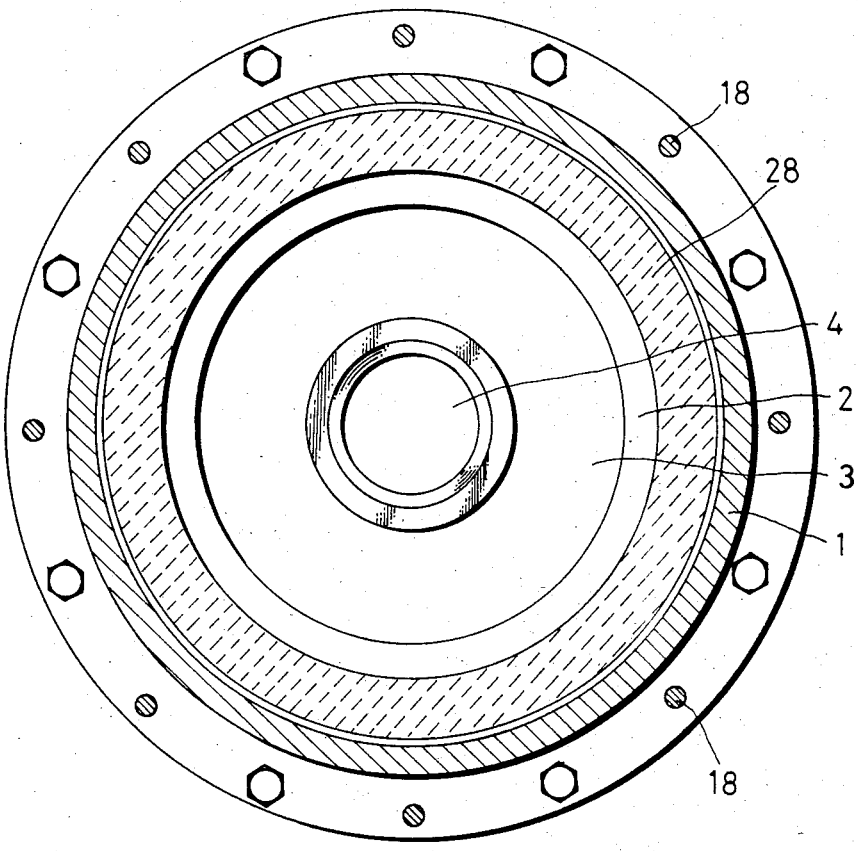
FIG. 2 is a horizontal section taken along the line II—II in FIG. 1.

Referring to the drawings, the preferred embodiments of the present invention are now described. A toroidal melting pot 2 set on a base body 1 defines a raw material sink 3 and is provided with a discharge port 4. This melting pot 2 is equipped with a water-cooling system comprising a water conduit 5, a water inlet 6 and a water outlet 7. A discharge pipe 8 communicates, at the top end thereof, with the discharge port 4 of the melting pot 2 and is equipped similarly with a water-cooling system comprising a water conduit 9, a water inlet 10 and a water outlet 11. The other end of the discharge pipe 8 communicates with a known means (not shown) for collecting produced fine grains. An electrically insulating ring 14, a ring plasma torch 15, another electrically insulating ring 16 and a lid member 17 are all arranged coaxially with the major axis of the apparatus in the upper portion thereof and are secured by fastening bolts, which are fixed against the base body 1. A hollow furnace is thus formed principally by said base body 1, said melting pot 2, said plasma torch 15 and said lid member 17. The plasma torch 15 comprises a pair of toroidal nozzle elements 20, 21 and a toroidal cathode 23. An annular nozzle opening 2 is formed between confronting lower edges of the nozzle elements 20 and 21. The major diameter of the nozzle opening 22 is adjusted to be a little larger than the average major radius of the raw material sink 3 so that a plasma arc 40 extending from the cathode 23, located between the nozzle elements 20, 21, may correctly be directed (on the oblique) down, through the nozzle opening 22 towards the raw material sink 3. The lower edge of the cathode 23 is formed as an arc-resisting member made of highly heat-resistant metal. The mutual electrical insulation and the positioning among mozzle elements 20, 21 and the cathode 23 are achieved by electrically insulating rings 25, 26. Gas inlets 27 for the neutral gas for plasma medium are made through the electrically insulating rings 25, 26. As the neutral gas, one of various gases, such a hydrogen, argon, nitrogen, helium or the like, is selected in accordance with an object. Numerals 28, 29 show construction members made of fire-resistant material. A gas feeder cylinder 33 for transfer gas is passed through the central portion of the lid member 17, is fixed thereto and is vertically provided along the major axis of the apparatus. A transfer gas outlet 34 is formed as the open bottom end of the gas feeder cylinder 33 and directed closely towards said discharge port 4. This gas feeder cylinder 33 is surrounded by a water-cooling system comprising a water conduit 35, a water inlet 36 and a water outlet 37. A magnetic field generating means 38 for plasma rotation, as a member of said plasma torch 15, comprises a circular coil provided coaxially with the plasma torch in the upper portion of the furnace and is adapted to generate, in the vicinity of the nozzle opening 22, a magnetic field having axial and radial components as shown by an arrow H. This magnetic field, as is disclosed in a Japanese patent application No. 46266/1980, has a component perpendicular to the plasma arc 40 jetting out throuch the nozzle opening 22 and is suitably distributed so as to drive electromagnetically the plasma arc azimuthally along the toroidal arc-resisting member 24.

Figure 3:
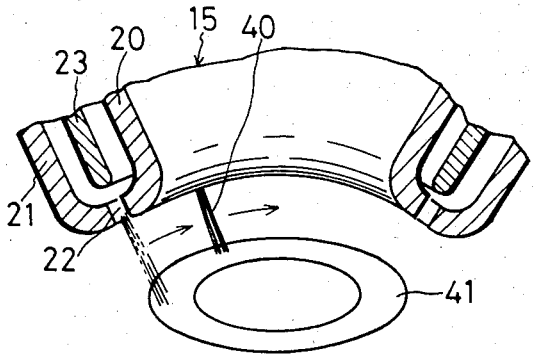
FIG. 3 is a fragmental perspective view in partial section, showing the relationship among a molten pool, a ring plasma torch and a plasma arc.

In the apparatus constructed as mentioned above, cooling water is first let to run through all the water conduits, and transfer gas is then jetted out from the transfer gas outlet 34 through the gas feeder cylinder 33 towards the discharge port 4. This transfer gas is preferably of the same kind as the neutral gas for plasma medium but may be of a different kind so long as produced fine grains are not degraded in purity. A raw material feeder 32 feeds the raw material sink 3 with a suitable amount of powdered raw material through a raw material passage 31. The raw material is electrically conductive in general and can be such a metallic material is iron, nickel, chrome, copper or an alloy of these metals or such a nonmetallic material as silundum or tungsten carbide. The neutral gas for plasma medium is supplied from the gas inlets 27 through the nozzle opening 22 to the raw material sink 3, the plasma torch 15 is struck by a well known step, the plasma arc 40 extends through the nozzle opening 22 and a gas mixture (including neutral molecules of the neutral gas, dissociated atoms, ionized ions and electrons) is jetted out as a plasma working gas. As a result of this, the plasma arc is elongated to the oblique down from the nozzle opening 22 towards the raw material sink 3. This plasma arc projects from the nozzle opening 22 as is usually known, i.e., as shown by the numeral 40 in FIG. 3 and is driven by such a component of the magnetic field generated by the magnetic field producing means 38 as perpendicular to the plasma arc, rotating continuously in the azimuthal direction. This rotating plasma arc 40 heats powdered raw material piled in the raw material sink 3 to change it into the molten pool 41. An arbitrary portion of the molten pool 41 is intermittently heated by said rotating plasma arc for a fixed period. Fine grains are formed on the surface of the molten pool 41 simultaneously with this process of heating by the plasma arc. That is, a certain portion of the molten pool 41 necesarily experiences the heating process where said portion of the molten pool is subject to the plasma arc 40 and the nonheating process where the process arc 40 deviates from said portion. In the heating process, the temperature at the surface of the molten pool becomes relatively high and reaches about 2000° C., for example, in the case of a molten iron pool. Some volume of the working gas of the plasma arc 40 is absorbed in the molten pool 41. Ionized ions and dissociated atoms constituting the plasma working gas are activated in attachment and affinity and accelerate further the absorption of the plasma working gas. In the nonheating process, on the other hand, the temperature on the surface of the molten pool is relatively lowered on account of heat conduction to the water-cooled melting pot 2 and is about 1350° C., for example, in the case of the molten iron pool. The gas absorbed in the heating process is thus in saturated state and therefore an amount of the absorbed gas necessary to eliminate this saturated state is discharged into the space over the molten pool 41. Some quantity of the molten raw material in the molten pool 41 is burst out into the space together with the discharged gas and is solidified in the form of fine grains due to rapid cooling.

The transfer gas is sent under pressure from the transfer gas outlet 34 of the gas feeder cylinder 33 towards the discharge port 4, and the static pressure around the discharge port 4 is lower than that over the molten pool 41 due to the speed of the transfer gas, a so-called suction effect taking place there. Moreover, the neutral gas for plasma medium is steadily getted out from the whole circumference of the nozzle opening 22 towards the surface of the molten pool 41 and flows thereafter to the discharge port 4. The fine grains formed in the space over the molten pool 41 are positively transferred along the radial direction of the apparatus towards the discharge port 4 by said suction effect and the flow of neutral gas for plasma medium and are further sent to the collecting means through the discharge pipe 8. Since the transfer of produced fine grains is thus swift and active, the fine grains have insufficient time to be mutually recombined, to be sintered or to be piled in the furnace. The collection of the produced fine grains is thus very effective.

Since the plasma arc 40 is azimuthally driven by the magnetic field H along the nozzle opening 22, fine grains are repeatedly burst out from an arbitrary portion of the molten pool 41 at a constant period, and the rate of production of fine grains at respective portions of the molten pool becomes homogeneous over the whole region of the toroidal molten pool. Since the plasma arc 40 is smoothly driven by the electromagnetic force originating from magnetic field, the arc spot on the surface of the molten pool moves smoothly as well. This also contributes largely to the high rate of production and the homogeneity of the dimensions of produced fine grains. Since the plasma arc 40 is rotating, some portion of the molten pool heated up by the plasma arc 40 to a high temperature is absorbing gas while another portion of the molten pool is simultaneously discharging the gas. These simultaneous absorption and discharge of gas make the production of fine grains all over the molten pool continuous and rich.

In the apparatus of this type, the plasma arc 40 can generally rotate at a rotating speed of 0.1 to 100 r.p.m., and the rotating speed is preferably from 1 to 20 r.p.m. for a desirable production of fine grains. This rotating speed is in fact determined so as to satisfy the following requirements. In accordance with the thermal conductivity of the raw material, the arc power and the ability of the water-cooled melting pot 2 to cool the molten pool 41, the rotating speed should give the heating region a temperature, higher than the melting point of the raw material, at which the activated particles in the plasma arc can abundantly be absorbed in the molten pool 41 while it should give the nonheating region a temperature, near the freezing point, at which abundant fine grains accompanying a sufficient amount of the absorbed gas are discharged.

For the purpose of the efficient production of fine grains, the nozzle opening 22 of the plasma torch 15 is preferably positioned against the melting pot 2 in the following manner. A straignt line 22*a* connecting the lower edge of the cathode 23 and the center of the nozzle opening 22 should intersect the central portion of the surface of the molten pool at an angle of $\alpha \approx 60°$. If the angle $\alpha$ lies between 15° and 75°, the production of fine grains itself is possible.

The produced fine grains can be transferred through the discharge pipe 8 without any stagnation by the afore mentioned suction effect and the high speed flow from the gas outlet 34 of abundant transfer gas. When a large amount of the neutral gas for plasma medium is jetted out from the nozzle opening 22, the produced fine grains, however, can be transferred by the flow of the neutral gas for plasma medium alone instead of the mixture of the neutral gas and the transfer gas under the suction force of an arbitrary suction means communicating with the lower end of the discharge pipe 8.

As is apparent from the aforegoind description of the present invention, since the raw material for fine grains accumulates in the form of a toroid with a wide surface area and the plasma arc 40 rotates azimuthally on this surface, the production region of fine grains is effectively enlarged and the productivity of fine grains is improved.

Furthermore, since the plasma arc 40, which rotates continuously in the azimuthal direction between the toroidal pile of raw material and the correspondingly toroidal nozzle opening 22 of the plasma torch 15, realizes alternately and periodically heating and nonheating processes on a certain portion of raw material and simultanetously makes possible these two processes on the raw material as a whole, the production of fine grains is further accelerated and the homogeneity of the produced fine grains is increased.

Moreover, since the large amount of fine grains produced from the wide surface of the toroidal pile of raw material is kept off the side wall of the furnace and is carried by the purely radial flow of the neutral gas for plasma medium, fine grains are prevented from diverging casually and attaching on the internal surface of the furnace, the yield of fine grains being further increased.

As many apparently widely different embodiments of this invention may be made without departing from the spirit and scope thereof, it is to be understood that the invention is not limited to the specific embodiments thereof except as defined in the appended claims.

What is claimed is:

1. A fine-grain-produced apparatus comprising a furnace, a toroidal melting pot provided in the lower portion of said furnace for containing a toroidal pile of raw material for fine grains, a ring plasma torch mounted over said pile of raw material for generating a plasma arc rotating azimuthally between said plasma torch and the surface of said pile of raw material, and a discharge port centrally provided around the major axis of said toroidal melting pot and communicating with the same for collecting fine grains produced from said pile of raw material together with neutral gas for plasma medium.

2. A fine-grain-producing apparatus as set forth in claim 1, wherein said ring plasma torch includes a pair of toroidal nozzle elements defining an annular nozzle opening between lower edges thereof, a toroidal cathode fixed between said nozzle elements and a means for generating, in the vicinity of said nozzle opening, a magnetic field having at least a component perpendicular to said plasma arc.

3. A fine-grain-producing apparatus as set forth in claim 1, wherein a gas feeder cylinder is provided along the major axis of the apparatus with the lower opening thereof directed closely towards said discharge port for passing transfer gas to transfer produced fine grains.

4. A fine-grain producing apparatus comprising:

(a) a hollow furnace, (b) a toroidal pile of raw material that has a top face and is positioned insude the furnace, (c) a ring plasma torch which (1) is separated from the toroidal pile of raw material and positioned to jet out neutral gas for plasma medium toward said toroidal pile of raw material, (2) can generate a plasma arc reaching the top face of the toroidal pile of raw material from the ring plasma torch and (3) can rotate and move the plasma arc along said toroidal pile of raw material, and (d) a discharge port, that is centrally positioned within space surrounded by the toroidal pile of raw material, for discharging produced fine grains together with the neutral gas.

* * * * *